US006585388B2

(12) United States Patent
Kim

(10) Patent No.: US 6,585,388 B2
(45) Date of Patent: Jul. 1, 2003

(54) BALL PEN HAVING LIGHT EMITTING DEVICE

(76) Inventor: Jin-woong Kim, 202-808, Bucheon Techno Park, 192, Yakdae-dong, Wonmi-gu, Bucheon-city, Kyungki-do (KR)

( * ) Notice: Subject to any disclaimer, the term of this patent is extended or adjusted under 35 U.S.C. 154(b) by 0 days.

(21) Appl. No.: 09/993,717

(22) Filed: Nov. 27, 2001

(65) Prior Publication Data

US 2003/0043573 A1 Mar. 6, 2003

(51) Int. Cl.[7] ..... B43K 29/10

(52) U.S. Cl. ..... 362/118; 362/204; 362/206; 401/195

(58) Field of Search ..... 362/253, 109, 362/118, 394, 204, 205, 203, 202; 401/195, 110

(56) References Cited

U.S. PATENT DOCUMENTS

| | | | | | |
|---|---|---|---|---|---|
| 3,288,115 | A | * | 11/1966 | Hechtle | 362/118 |
| 5,413,428 | A | * | 5/1995 | Kageyama | 401/195 |
| 5,523,928 | A | * | 6/1996 | Kim | 362/118 |
| 5,735,592 | A | * | 4/1998 | Shu | 401/195 |
| 6,129,473 | A | * | 10/2000 | Shu | 401/195 |

FOREIGN PATENT DOCUMENTS

| | | |
|---|---|---|
| JP | 3058038 | 3/1999 |

* cited by examiner

*Primary Examiner*—Sandra O'Shea
*Assistant Examiner*—John Anthony Ward
(74) *Attorney, Agent, or Firm*—Nixon & Vanderhye, P.C.; Frank P. Presta

(57) ABSTRACT

A ball pen including a light emitting device is provided. In the ball pen, a light emitting diode (LED) is enclosed in a figurine attached to the end of the ball pen and two electric wires are connected to the LED. One of the wires is connected to one electrode of a battery and the other is in contact with a cone-shaped spring positioned at the lower portion of the battery. The cone of the cone-shaped spring is pushed up by an ink cartridge, making the cone-shaped spring come into contact with one electrode of the battery, so that an electric current flows through a circuit including the battery and the LED, thereby illuminating the LED. A stick is firmly engaged with the push button member and thus, the push button member is pushed to make inclined surfaces of a cylinder-rotation sawtooth and an inclined protruding stopper, which are formed in a rotational cylinder, glide along the inclined surfaces of the cylinder-rotation side protrusions, thereby rotating the rotational cylinder. Whenever the rotational cylinder is rotated, the point of the ball pen sticks out or goes back into the tip hole of the ball pen. According to the ball pen including a light emitting device, the light emitting device can be lit not only when the point of the ball pen is pressed on paper, but also when the push button member is pushed to use or not to use the ball pen. Therefore, the ball pen including the light emitting device can attract the interest of a user.

2 Claims, 7 Drawing Sheets

BALL PEN HAVING LIGHT EMITTING DEVICE

BACKGROUND OF THE INVENTION

1. Field of the Invention

The present invention relates to a ball pen including a light emitting device at its end, and more particularly, to a ball pen having a light emitting device that lights up when a user writes with it or presses down on its end, thus being pretty to look at and fun to play with.

2. Description of the Related Art

A ball pen is the most widely used writing tool. However, a general ball pen does not have any specific functions other than writing. Inspired by this point, the present applicant has registered Korean utility model (U.M.) No. 211781 entitled "Ball Pen Having Light Emitting Device" with the Korean Industrial Property Office (KIPO). The ball pen according to the above U.M. includes a light emitting device made of a light emitting diode (LED) at its end and an ink cartridge functions as a switching button, connecting the LED with a battery by electric wires when the ink cartridge is pressed on paper for writing, thus lighting the LED.

In detail, in the ball pen including a light emitting device according to the above U.M., colored light is generated from a colored cover enclosing the LED at the end of the ball pen, thus attracting the interest of a user. Therefore, it is easy to lead children to write or draw a picture with the ball pen, thereby increasing their learning efficiency. However, this ball pen has a simple emitting mechanism in which light is generated only if a point of the ball pen is pressed.

SUMMARY OF THE INVENTION

To solve the above problem, it is a first objective of the present invention to provide a ball pen including a light emitting device that lights up when either the end or the point of the ball pen is pressed.

It is a second objective of the present invention to provide a ball pen including a light emitting device, wherein the end of the ball pen is pressed once to use the pen and is pressed again not to use the pen.

It is a third objective of the present invention to provide a ball pen including a light emitting device in which a push button member, which is pressed to push out a ball-point of the ball pen, is elastically biased upward by a helical compressive spring, thereby preventing the push button member from being loose and moving.

Accordingly, to achieve the above objective, there is provided a ball pen comprising a light emitting device in which first and second electric wires are connected to a light emitting diode (LED); a battery installed at the bottom of the light emitting device, one electrode of the battery being in contact with the first electric wire connected to the LED; and a cone-shaped spring installed near one electrode of the battery, the tip of the cone-shaped spring contacting the ink cartridge and the base of the cone-shaped spring contacting the second electric wire connected with the LED, wherein when the cone-shaped spring is compressed by the ink cartridge, the cone of the cone-shaped spring comes into contact with one electrode of the battery and an electric current flows through the cone-shaped spring, thereby illuminating the LED.

BRIEF DESCRIPTION OF THE DRAWINGS

The above objectives and advantages of the present invention will become more apparent by describing in detail a preferred embodiment thereof with reference to the attached drawings in which.

DETAILED DESCRIPTION OF THE INVENTION

Figure 1:
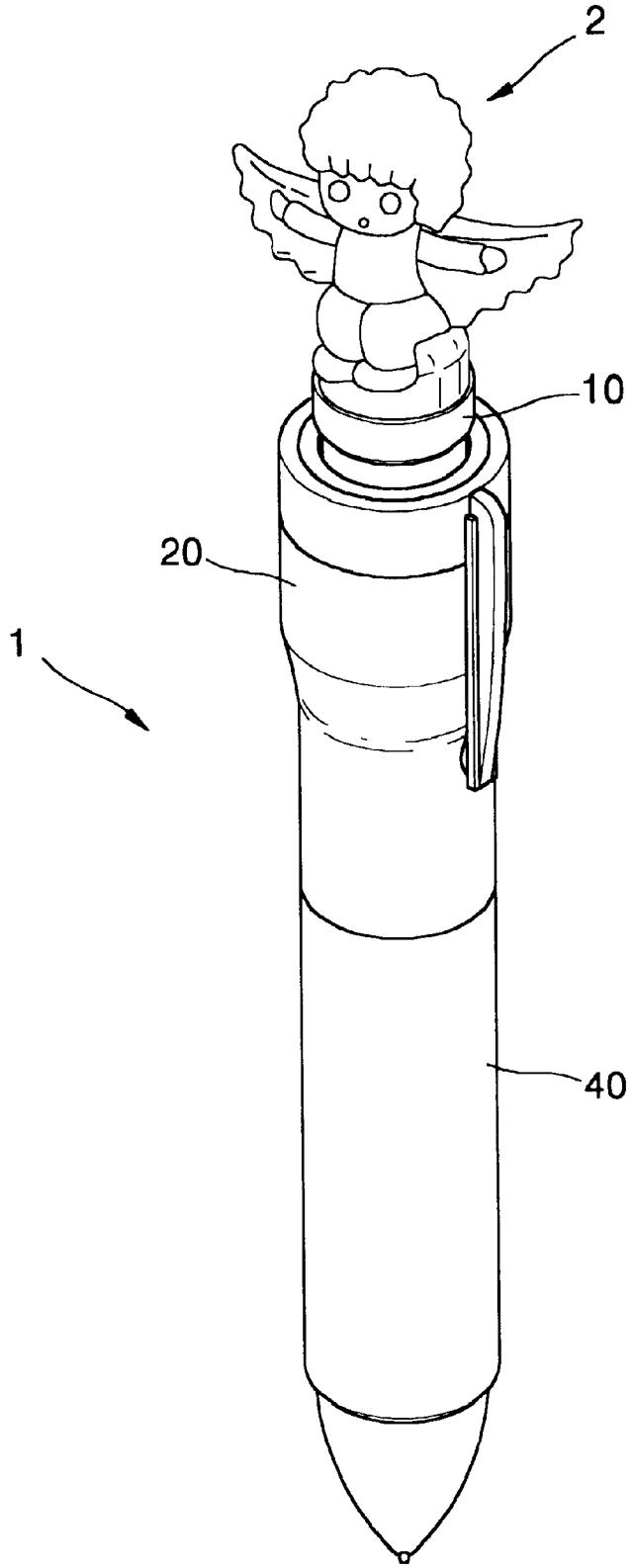
FIG. 1 is a perspective view of a ball pen having a light emitting device according to the present invention.

FIG. 1 is a view of a ball pen including a light emitting device enclosed in a figurine 2. The shape of the figurine 2 may vary, but is preferably made of transparent material so that light is transmitted through the figurine 2 when the light emitting device is lit.

Figure 2:
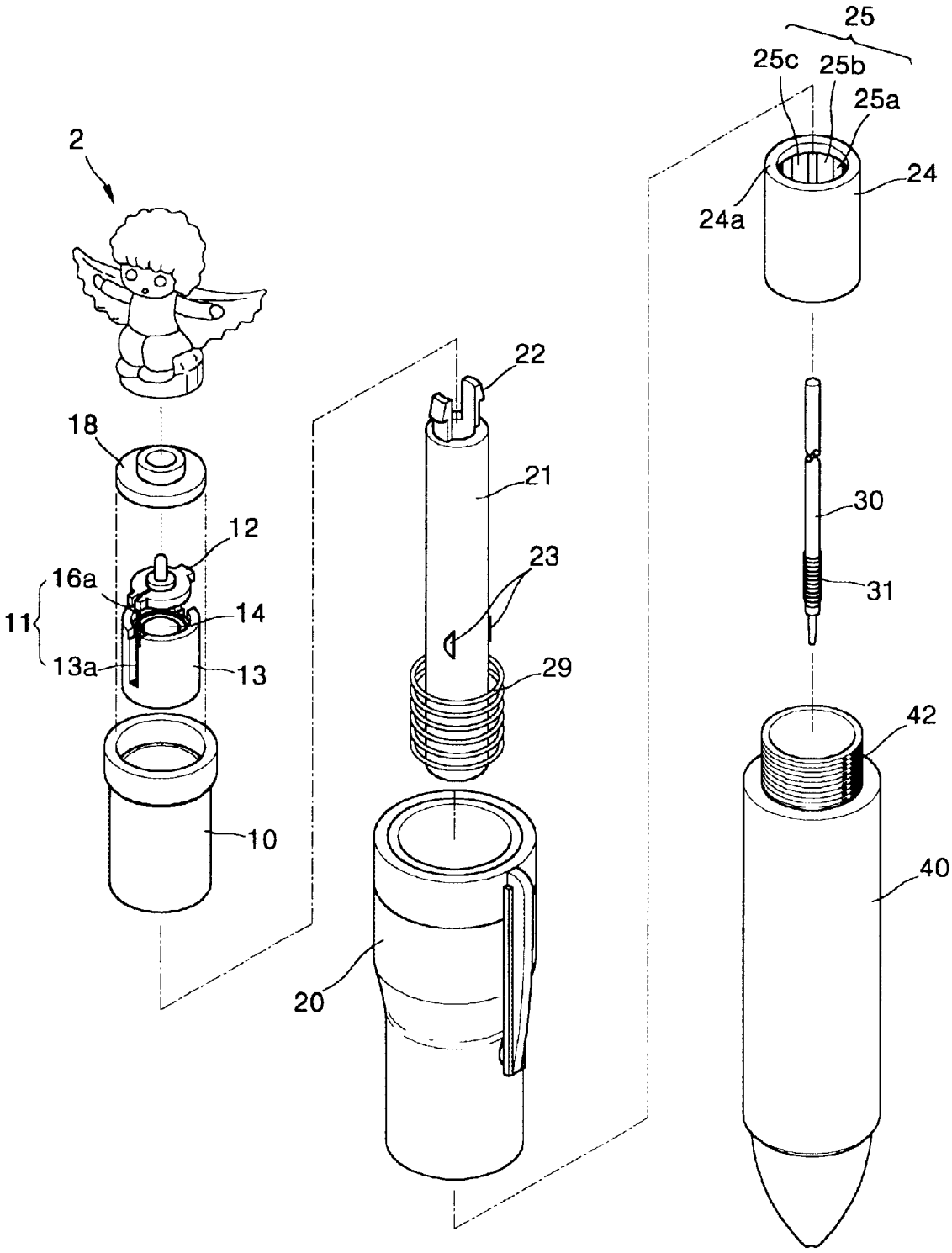
FIG. 2 is an exploded perspective view of a ball pen having a light emitting device according to the present invention.
Figure 3:
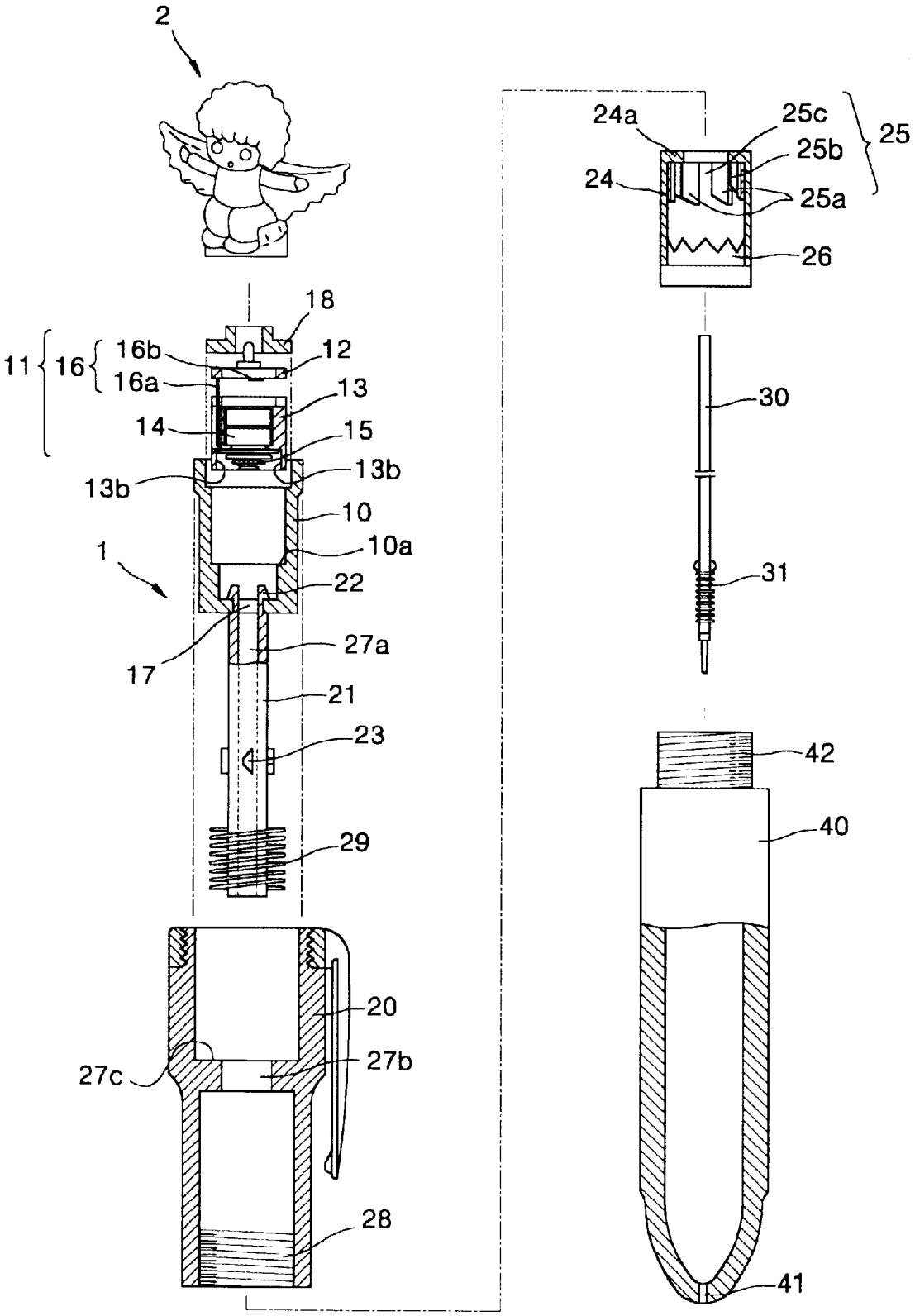
FIG. 3 is an exploded cross-sectional view of a ball pen having a light emitting device according to the present invention.
Figure 4:
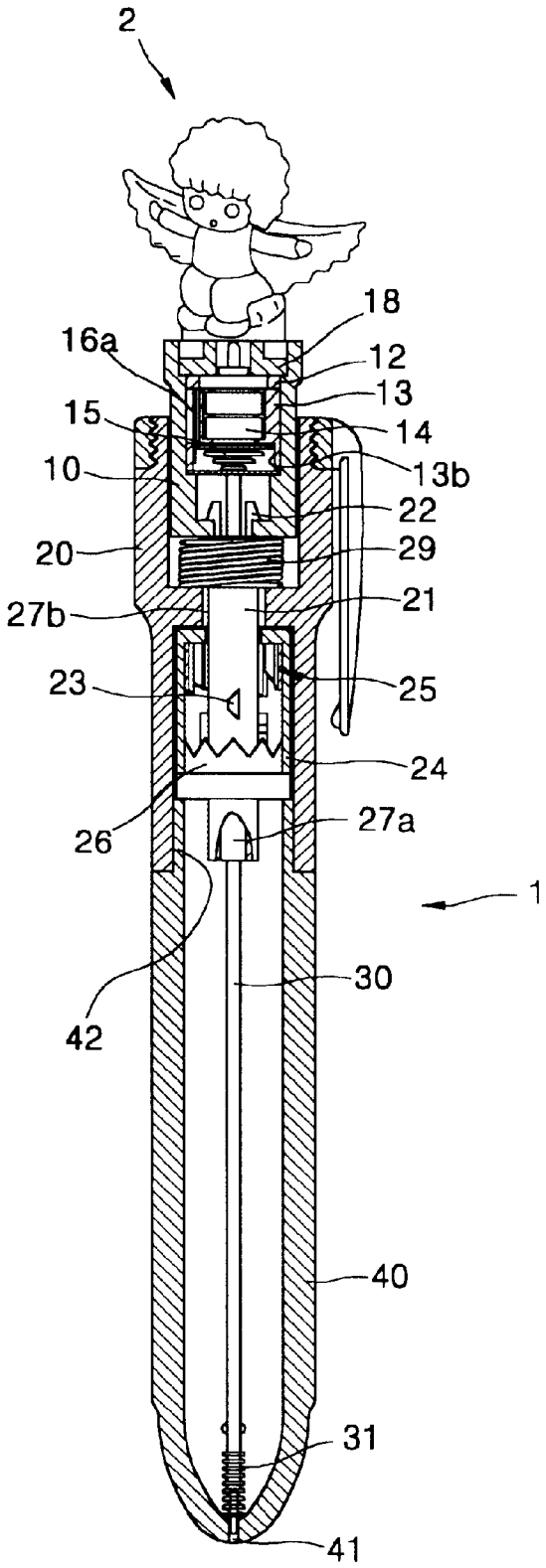
FIG. 4 is a cross-sectional view of a ball pen having a light emitting device according to the present invention in an assembled state.

FIG. 2 is an exploded perspective view of a ball pen having a light emitting device 11 according to the present invention. FIG. 3 is an exploded cross-sectional view of the ball pen of FIG. 2. FIG. 4 is a cross-sectional view of all components for the ball pen according to the present invention in an assembled state.

The light emitting device 11 is composed of a light emitting diode (LED) assembly 12 attached to a plastic base; a battery 14; first and second electric wires 16*a* and 16*b*; a battery housing 13; and a cone-shaped spring 15. The LED assembly 12 and the battery housing 13 are made of nonconductors, and the first and second electric wires 16*a* and 16*b* and the cone-shaped spring 15 are made of conductors.

Once all the components for a ball pen according to the present invention are assembled, the upper portion of an ink cartridge 30 is positioned on the tip of the cone of the cone-shaped spring 15. At the bottom of the LED assembly 12, the second electric wire 16*b*, which is connected to one of electrodes of the LED, is bent horizontally to contact a pole of the battery 14. The first electric wire 16*a*, which is connected to the other pole of the battery 14, is elongated from the edge of the LED assembly 12 to protrude like a pin and is fixed to contact the surface of the cone-shaped spring 15, passing through a wire pass groove 13*a* on a side of the battery housing 13. The cone-shaped spring 15 has a cone shape with its base toward the battery 14. The circumference of the base of the cone-shaped spring 15 is fixed to contact the first electric wire 16*a*, being engaged with second circular seats 13*b* which are lower parts of the battery housing 13. The cone-shaped spring 15 must be positioned not to contact the battery 14 when the ball pen is not used.

When the point or the end of the ball pen according to the present invention is pressed for writing, the upper portion of the ink cartridge 30 pushes to compress the cone-shaped spring 15. As a result, the center of the cone-shaped spring 15 contacts the electrode of bottom of the battery 14, and thus, an electric current flows through a circuit (not shown) connecting the battery 14 with the LED, thus lighting the LED. In the meanwhile, if force applied to the ink cartridge 30 is removed, the ink cartridge returns to its original position and the center of the cone-shaped spring 15 is separated from the pole of the battery 14 due to the elastic repulsion of the cone-shaped spring 15. As a result, the light of the LED turns off.

The light emitting device including the battery housing 13 is mounted in a push button member 10 and the LED assembly 12 is covered with an LED cover 18. The lower portion of the battery housing 13 is mounted on a first circular seat 10*a* and the cone of the cone-shaped spring 15 is in contact with the upper portion of the ink cartridge 30.

A first positioning hole 17 is formed at the bottom of the push button member 10. Two sliding blocks 22, which are mounted on a stick 21, are inserted into the first positioning hole 17. The stick 21 has a tube in the longitudinal direction, through which the ink cartridge 30 can pass. The two sliding blocks 22 are facing each other on the stick 21 and have inclined ends. Therefore, when the two sliding blocks 22 are pushed into the first positioning hole 17 formed at the bottom of the push button member 10, they become bent elastically and inserted into the first positioning hole 17. After the insertion of the sliding blocks 22, they are restored to their original state, i.e. they straighten out, and are firmly fixed in the first positioning hole 17.

A plurality of cylinder-rotation side protrusions 23 are formed at the middle of the stick 21. In the preferred embodiment of the present invention, three cylinder-rotation side protrusions 23 are mounted at the middle of the stick 21, spaced 120 degree apart around the stick 21. Each of the protrusions 23 protrudes to a predetermined thickness from the wall of the stick 21 and its upper and lower surfaces are inclined at a predetermined angle. Around the stick 21, a helical compressive spring 29 is placed.

The push button member 10, the upper portion of the stick 21 and the helical compressive spring 29 are mounted on a partition 27*c* which is placed in the middle of a trunk portion 20. The partition 27*c* has a second positioning hole 27*b* at its center. The stick 21 passes through the second positioning hole 27*b* and is combined with a rotational cylinder 24. In the rotational cylinder 24, an inclined protruding stopper 25 of a predetermined thickness is formed along the wall in the direction of the upper portion of the ball pen and a cylinder-rotation sawtooth 26 is formed along the wall in the direction of the lower portion of the ball pen.

Figure 5:
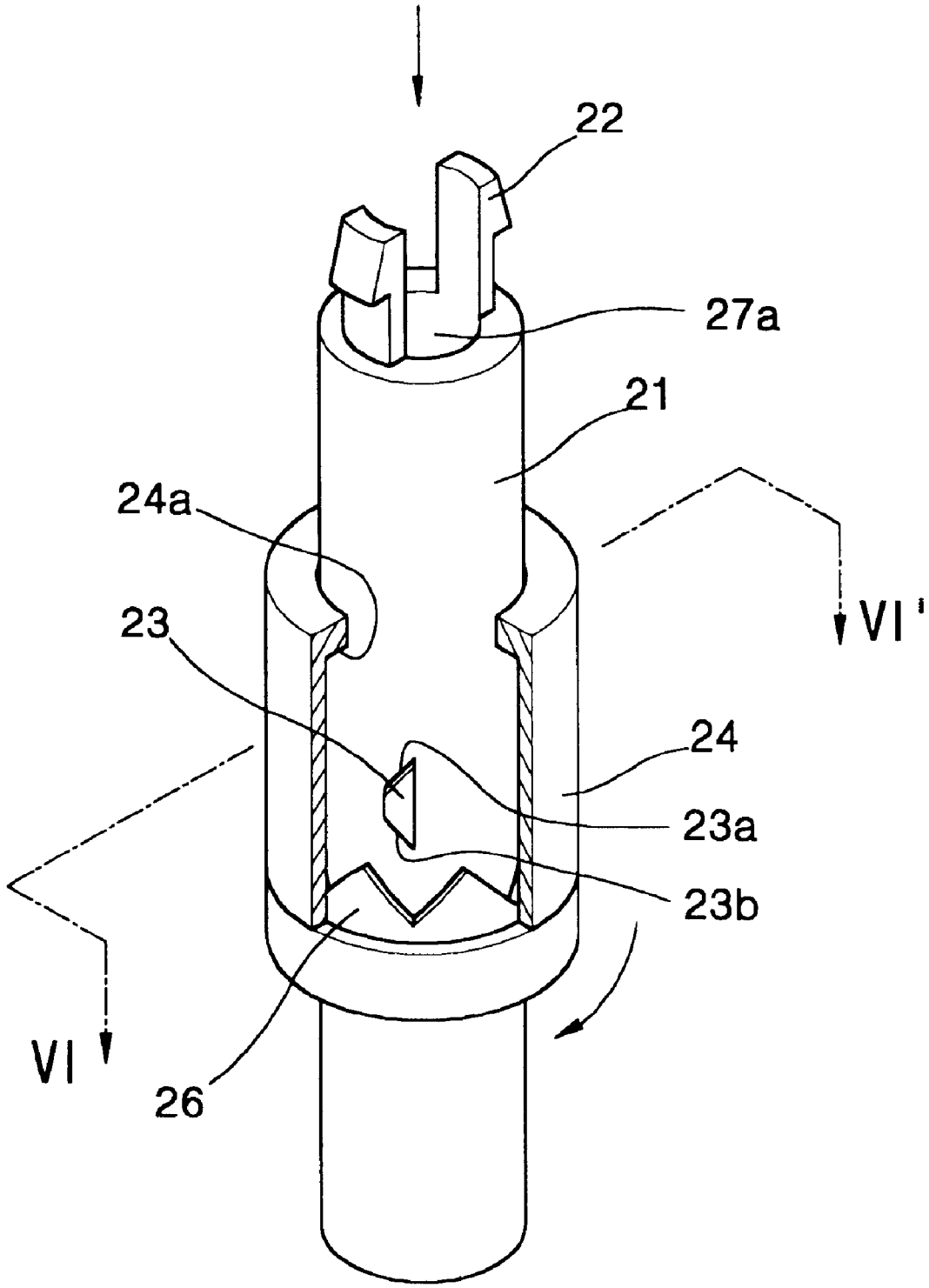
FIG. 5 is a partially cut away perspective view of a stick and a rotational cylinder of a ball pen having a light emitting device according to the present invention in an assembled state.

FIG. 5 is a partially cut perspective view of the stick 21 and the rotational cylinder 24 in an assembled state. The stick 21, which is inserted into the rotational cylinder 24, does not easily slide from the rotational cylinder 24 because cylinder-rotation side protrusions 23 are engaged with a cylinder-rotation sawtooth 26 and an inclined protruding stopper 25 of the rotational cylinder 24 and a stop seat 24*a* of the upper portion of the rotational cylinder 24.

As shown in FIGS. 2 through 4, the rotational cylinder 24 is inserted into the lower portion of the trunk portion 20, and then the ink cartridge 30 is installed, passing through a through hole 27*a* of the stick 21. Then, a barrel thread 42 of a barrel 40 and a trunk portion inner thread 28 are engaged with each other, thus the barrel 40 screws into the trunk portion 20. As a result, the rotational cylinder 24 is fixed in the lower portion of the trunk portion 20 in the longitudinal direction of the ball pen.

Figure 6:
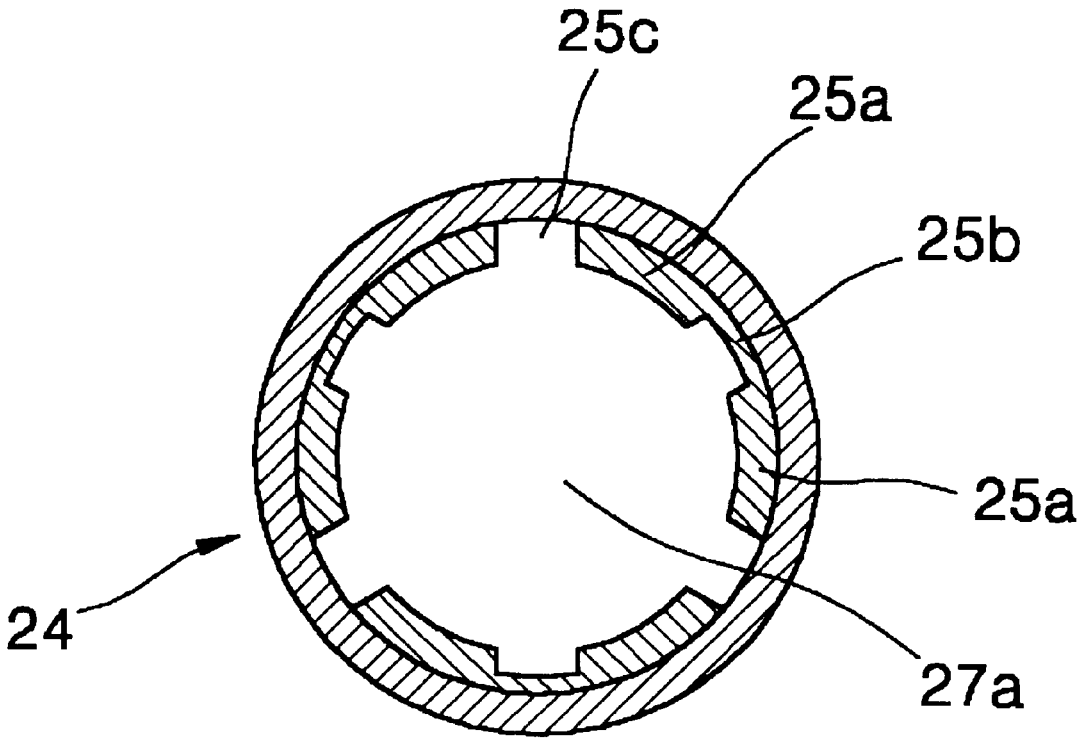
FIG. 6 is a cross-sectional view of the upper portion of the rotational cylinder of the ball pen of FIG. 5, taken along the line VI–VI'.

FIG. 6 is an exploded cross-sectional view of the rotational cylinder 24 of FIG. 5, taken along the line VI–VI'. Referring to FIGS. 5 and 6, an inclined protruding stopper 25 is formed along the inner walls of the rotational cylinder 24 in the direction of the push button member 10 when all components of the ball pen according to the present invention are assembled. The cylinder-rotation sawtooth 26 is formed opposite to the inclined protruding stopper 25. An upper inclined surface 23*a* of each cylinder-rotation side protrusions 23 formed at the middle of the stick 21 is manufactured to have the same angle as each of the inclined surfaces of the inclined protruding stopper 25 formed in the rotational cylinder 24. A lower inclined surface 23*b* of each cylinder-rotation side protrusions 23 is made to have the same angle as each tooth of the cylinder-rotation sawtooth 26.

In FIG. 5, if the stick 21 is moved downward as indicated by an arrow, the cylinder-rotation sawtooth 26 of the rotational cylinder 24 glides along the lower inclined surface 23*b*, and as a result, the rotational cylinder 24 is rotated at a predetermined angle in the direction of an arrow.

Figure 7:
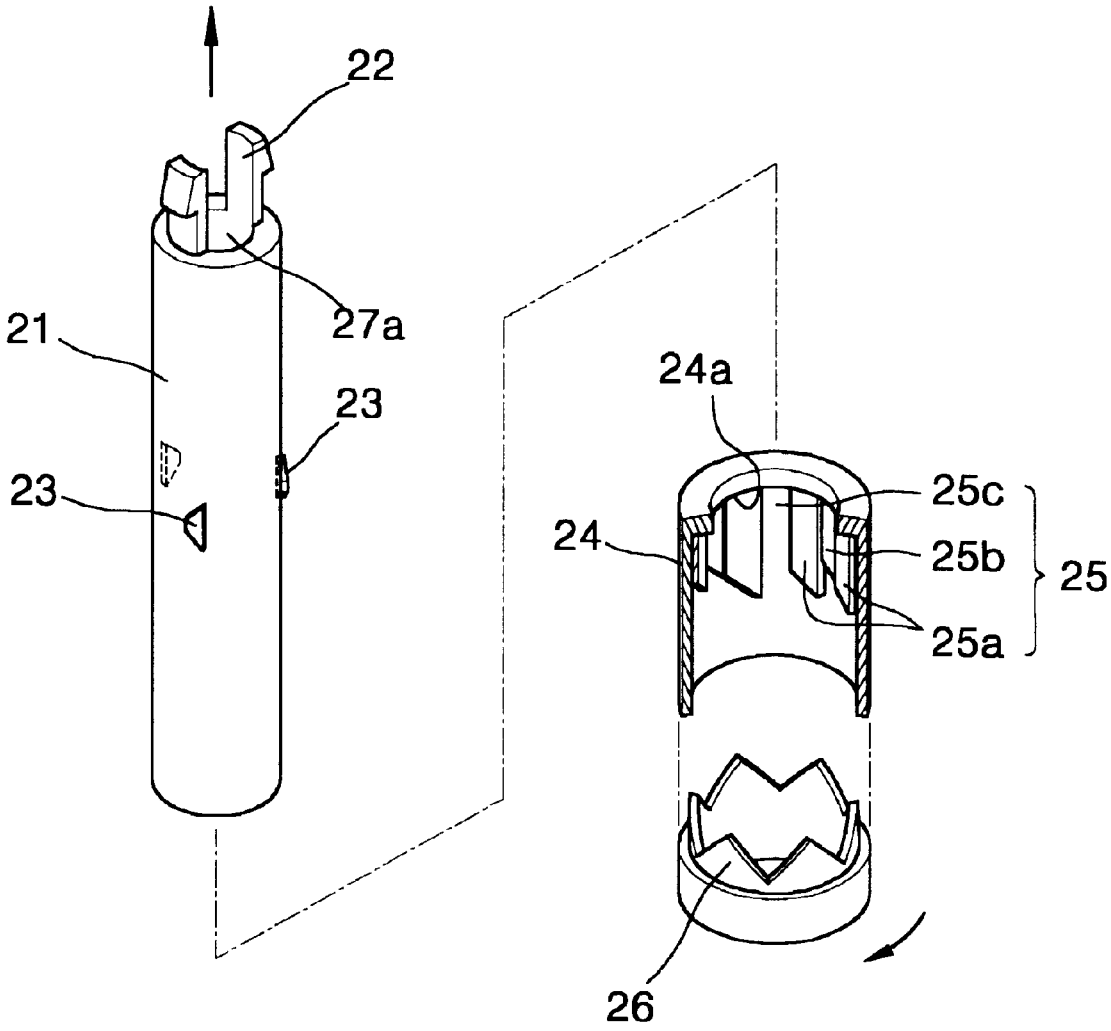
FIG. 7 is a schematic view showing how a rotational cylinder is rotated when a stick rises and falls.

Referring to FIG. 7, if the stick 21 is raised in the direction of an arrow, the inclined surfaces 25*a* and 25*b* of the inclined protruding stopper 25 of the rotational cylinder 24 glide along the upper inclined surface 23*a*, and as a result, the rotational cylinder 24 is rotated in the direction of an arrow.

When a user presses the push button member 10 downward to use the ball pen, the upper portion of the ink cartridge 30 is pushed by an electrode of the battery 14 and the cone-shaped spring 15. As a result, a point of the ball pen comes out of a tip hole 41 of the barrel 40 and the stick 21 is moved downward together with the push button member 10. A cross-section of the stick 21 takes on a polygonal shape, e.g., a square, as does the second positioning hole 27*b* of the trunk portion 20. For this reason, the stick cannot be rotated. In other words, the stick 21 is combined with the push button member 10 and thus, cannot be independently moved upward/downward nor rotated.

When the stick 21 is lowered, the cylinder-rotation side protrusions 23 glide along an inclined surface of the cylinder-rotation sawtooth 26, and as a result, the rotational cylinder 24 rotates at the lower portion of the trunk portion 20 by a predetermined angle.

If the force applied to the push button member 10 is removed, the push button member 10 is moved upward by the restoring force of stability of the helical compressive spring 29 which is elastically compressed between the bottom of the push button member 10 and the partition 27*c* of the trunk portion 20. At this time, the stick 21 is also raised and the inclined surfaces 25*a* and 25*b* of the inclined protruding stopper 25 glide along the upper inclined surface 23*a*of the cylinder-rotation side protrusions 23, thereby rotating the rotational cylinder 24 at a predetermined angle.

In the case that the cylinder-rotation side protrusions 23 are stopped, being engaged with the inclined surface 25*b*, the push button member 10 comes to a standstill on the way back. At this time, the ink cartridge 30 is exposed outside of the tip hole 41 and the ball pen can be used for writing.

Meanwhile, while the push button member 10 is lowered, the upper portion of the ink cartridge 30 presses the cone-shaped spring 15 and thus, an electrode of the battery 14 comes into contact with the cone-shaped spring 15, thereby illuminating the LED. Also, if the push button member 10 gets hooked by the inclined surface 25*b* in the midst of being raised, and the ink cartridge 30 comes out of the tip hole 41, the cone-shaped spring 15 comes away from the electrode of the battery 14 due to the restoring force of the cone-shaped spring 15, thereby extinguishing the LED. Also, if the point of the ball pen comes out of the tip hole 41 and is pressed on paper for writing, the LED is illuminated.

If the push button member 10 is again pressed downward with the cylinder-rotation side protrusions 23 of the stick 21 being hooked by the inclined surface 25*b*, an inclined surface of the cylinder-rotation sawtooth 26 of the rotational cylinder 24 glides along the lower inclined surface 23*b* of the cylinder-rotation side protrusions 23, thereby rotating the rotational cylinder 24 at a predetermined angle. At this time, the cone of the cone-shaped spring 15 comes into contact with one electrode of the battery 14, thus illuminating the LED.

The removal of the force applied to the push button member 10 causes the push button member 10 to move upward due to the restoring force of the helical compressive spring 29. As a result, the cylinder-rotation side protrusions 23 is moved upward along a vertical groove 25*c*, and then is stopped, being hooked by the stop seat 24*a*. At this time, the point of the ball pen retreats back into the barrel 40.

In the ball pen including the light emitting device according to the present invention, the LED is illuminated not only when the point of the ball pen is pressed on paper for writing, but also when the push button member 10 is pushed to make the point of the ball pen stick out through the tip hole 41 or go back into the tip hole 41. In conclusion, every time the ball pen is used, the LED can be illuminated, brightening the figurine 2, which attracts the interest of a user.

Also, the ball pen including a light emitting device according to the present invention is advanced because it is operated by pushing a push button member, i.e., pushing the push button member causes the point of the ball pen to stick out of or go back into the tip hole of the ball pen. Further, the LED is illuminated whenever the push button member is pushed, as well as when the point of the ball pen is pressed on paper or the like. In addition, in the present invention, various different figurines can be used to cover the LED, thus attracting the interest of a user all the more.

While this invention has been particularly shown and described with reference to a preferred embodiment thereof, it will be understood by those skilled in the art that various changes in form and details may be made therein without departing from the spirit and scope of the invention as defined by the appended claims.

What is claimed is:

1. A ball pen including an ink cartridge, the ball pen comprising:

a light emitting device in which first and second electric wires are connected to a light emitting diode (LED) (12);

a battery (14) installed at the bottom of the light emitting device, one electrode of the battery being in contact with the first electric wire (16*b*) connected to the LED;

a cone-shaped spring (15) installed near the other electrode of the battery (14), the tip of the cone-shaped spring contacting the ink cartridge (30) and the base of the cone-shaped spring contacting the second electric wire (16*a*) connected with the LED, a push button member (10) containing the LED (12), the battery (14) and the cone-shaped spring (15), the push button member having a positioning hole (17) formed at its bottom;

a stick (21) having longitudinal hole through which the ink cartridge (30) can pass, and having a plurality of cylinder-rotation side protrusions (23) formed in the middle of the stick, the upper end of the stick being inserted into the positioning hole of the push button member;

a rotational cylinder (24) encircling the lower portion of the stick (21) and having an inclined protruding stopper (25) protruding from its inner wall at the upper end of the rotational cylinder nearest the push button member (10) and a cylinder-rotation sawtooth (26) protruding from its inner wall at the lower end of the rotational cylinder;

a trunk portion (20) having a cylinder shape and open ends and being divided into an upper portion and a lower portion by a partition formed in the middle of the trunk portion, the partition having a through hole (27*b*) at its center, the push button member (10) being inserted into the upper portion, the rotational cylinder (24) being inserted into the lower portion, the stick (21) extending through the through hole (27*b*) so that the push button member (10) and the rotational cylinder (24) may be assembled by means of the stick, the trunk portion (20) having a helical compressive spring which is installed between the push button member (10) and the partition, and encircles the stick (21); and a barrel (40) having the ink cartridge (30) therein, the upper end of the barrel being inserted into the lower portion of the trunk portion (20) so that the barrel may be combined with the trunk portion to rotatably fix the rotational cylinder (24) between the upper end of the barrel and the partition of the trunk portion, wherein pressing the push button member (10) or pushing a point of the ball pen attached to the end of the ink cartridge (30) causes the ink cartridge (30) to compress the cone-shaped spring (15), causing the tip of the cone-shaped spring (15) to contact the other electrode of the battery, thereby illuminating the LED.

2. The ball pen as claimed in claim 1, wherein the cylinder-rotation side protrusions (23) each has an upper inclined surface and a lower inclined surface, the upper inclined surface having substantially the same angle as an inclined surface of the inclined protruding stopper (25) of the rotational cylinder (24), the lower inclined surface having substantially the same angle as an inclined surface of the cylinder-rotation sawtooth (26) of the rotational cylinder (24).

* * * * *